United States Patent [19]

Meggs et al.

[11] 3,936,110

[45] Feb. 3, 1976

[54] COMBINATION CABINET FOLD-OUT BAR

[76] Inventors: Daniel H. Meggs, 4313 Vista Largo; Janos Beny, 4445 Pacific Coast Highway, both of Torrance, Calif. 90505

[22] Filed: May 13, 1974

[21] Appl. No.: 469,130

[52] U.S. Cl. ..... 312/241; 108/38; 312/316

[51] Int. Cl.[2] ..... A47B 85/00

[58] Field of Search ..... 312/240, 241, 242, 313, 312/282, 316, 324; 108/38, 48

[56] References Cited

UNITED STATES PATENTS

| | | | |
|---|---|---|---|
| 1,195,964 | 8/1916 | Bradley | 108/38 |
| 1,948,703 | 2/1934 | Fanarjian | 312/316 |
| 2,810,617 | 10/1957 | Slanhoff | 312/241 |
| 2,870,459 | 1/1959 | Zabielski | 312/316 |
| 3,456,600 | 7/1969 | Sanchez | 108/38 |

FOREIGN PATENTS OR APPLICATIONS

| | | | |
|---|---|---|---|
| 1,087,973 | 10/1967 | United Kingdom | 312/241 |

*Primary Examiner*—Paul R. Gilliam
*Assistant Examiner*—Kenneth J. Dorner
*Attorney, Agent, or Firm*—Herzig & Walsh, Incorporated

[57] ABSTRACT

A cabinet having a lower door which opens outwardly and an upper door which opens downwardly to rest on the opened lower door; thereby the cabinet may be converted into a bar. The lower door preferably has an extension hinged to its outer end which folds outwardly and the upper door is preferably right angularly shaped to overlie the extension when it is folded open.

4 Claims, 4 Drawing Figures

COMBINATION CABINET FOLD-OUT BAR

BACKGROUND OF THE INVENTION

The present invention relates to a combination cabinet fold-out bar.

SUMMARY OF THE INVENTION

It is an object of the present invention to provide a cabinet having doors which may be opened and selectively positioned without removing the doors to convert the cabinet into a bar.

In accomplishing these and other objects, there is provided a cabinet having a lower door which opens outwardly and an upper door which opens downwardly to rest on the opened lower door; thereby the cabinet may be converted into a bar. The lower door preferably has an extension member hinged to its outer end which folds outwardly and the upper door is preferably right angularly shaped to overlie the extension when it is folded open. Rollers are preferably mounted on the lower edges of the lower door and its extension member.

Additional objects of the present invention reside in the exemplary cabinet fold-out bar combination illustrated in the several drawings and hereinafter described in conjunction therewith.

DETAILED DESCRIPTION OF THE PREFERRED EMBODIMENT

Figure 1:
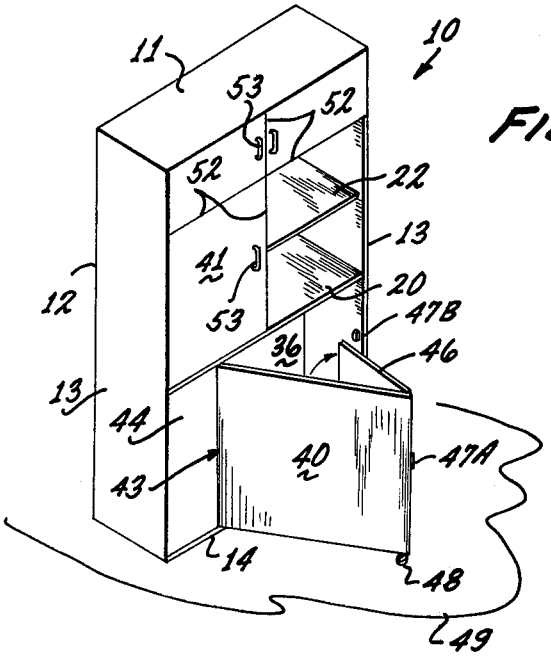
FIGS. 1–3 are perspective views of a cabinet fold-out bar combination according to the present invention illustrating conversion of the combination from a cabinet to a bar.

Referring to the drawings in more detail, there is shown a combination cabinet fold-out bar unit generally identified by the numeral 10. The unit 10 illustrated has a rectangular shape and is made up of a top wall 11, back wall 12, side walls 13 and a bottom wall 14. The walls 12 and 13 are shown extending vertically while the walls 11 and 14 extend horizontally.

The unit 10 is divided into an upper and lower portion by a horizontally extending shelf member 20. Additional compartments and shelves are formed in the upper portion of the unit 10 by the horizontally extending partition walls 21–23 and the vertically extending partition wall 24. The upper portion of the unit 10 is shown divided into compartments 31–35 while its lower portion is illustrated as one large compartment 36.

The bottom wall 14 and the shelf member 20 define vertically spaced apart horizontally extending support members for supporting the doors of the unit 10. It is noted that the support members provided by the wall 14 and the shelf member 20 are positioned flush with the forward edge of the unit 10.

The unit 10 has a lower door 40 and an upper door 41. The lower door 40 is a rectangular shaped planar member and is mounted by hinges 42 in the bottom portion of the unit 10 to pivot about a vertically extending axis identified by the numeral 43. The length of the door 40 is shown being equal to a distance approximately equal to three-fourths of the width of the unit 10. When moved into a closed position flush with the front edge of the unit 10, the door 40 closes the right lower portion of the unit 10. The remainder of the lower portion of the unit 10, which is to the left of the door 40, is closed by a fixed panel 44.

Mounted by hinges 45 on the outer end of the lower door 40 is an extension member 46. The extension member 46 is a rectangular shaped planar member having the same height as the door 40 but a shorter length. As shown in the drawings, the extension member 46 may be folded against the inside surface of the door 40 for storage or folded outwardly to a position where it extends perpendicularly to the plane of the door 40. A conventional latching arrangement made up of parts 47A and 47B are associated with the outer edge of the lower door 40 and the right hand side wall 13 for latching the door 40 in a closed position. Rollers 48 are mounted on the lower edges of the door 40 and extension member 46 adjacent their outer ends for rolling across the floor surface 49 upon which the unit 10 is illustrated positioned when the lower door 40 is opened and closed.

The upper door 41 is mounted by hinges 50 on the shelf member 20 to pivot about a horizontal extending axis. The door 50 is a planar member illustrated shaped as a right angle or inverted L-shaped member which when pivoted upwardly to a closed position, as shown in FIG. 1, closes the compartments 31, 32 and 34. A latch arrangement 51 similar to the latch arrangement 47A, 47B is provided in the edge of the door 41 for latching it in a closed position. It is noted that for esthetic reasons lines or grooves 52 are shown on the front of the door 41 to give the appearance that the door 41 is three individual doors rather than the single planar member which it is. Also, handles 53 may be mounted on the door member 41 as illustrated.

In use of the combination unit 10, a cabinet is provided when the doors 40 and 41 are latched closed. Access to any particular shelf or compartment is achieved by opening the appropriate one of the doors 40 and 41.

Figure 2:
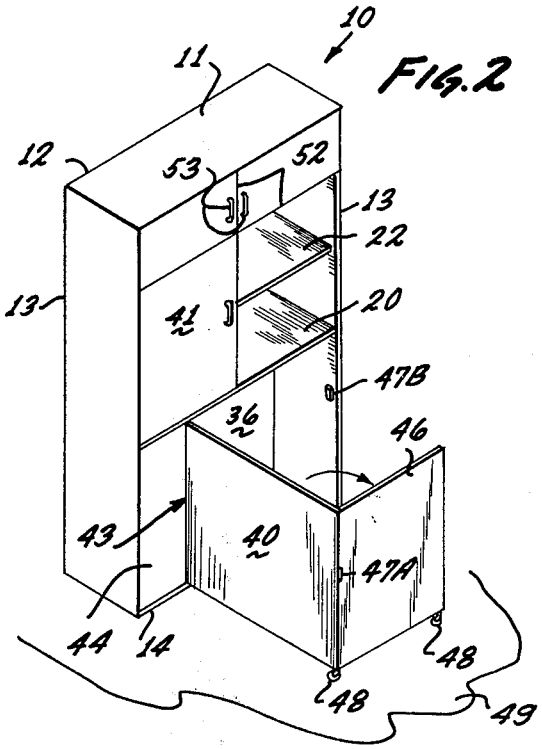
Figure 3:
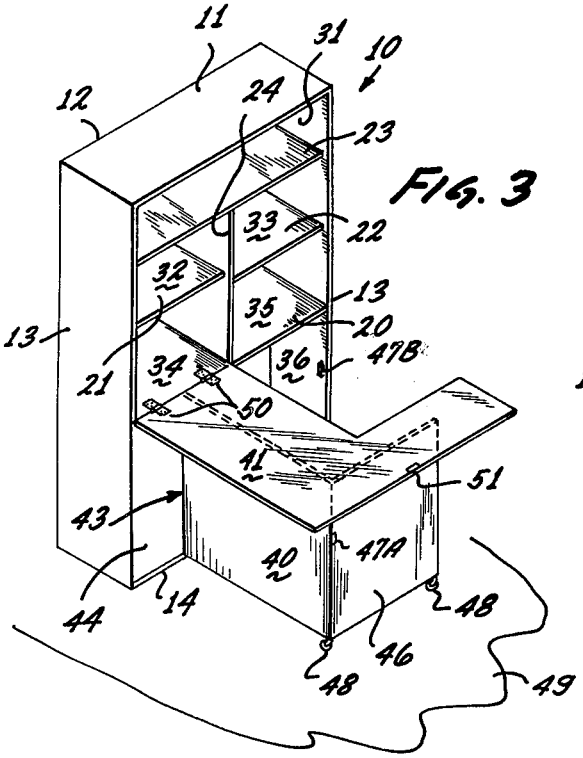
Figure 4:
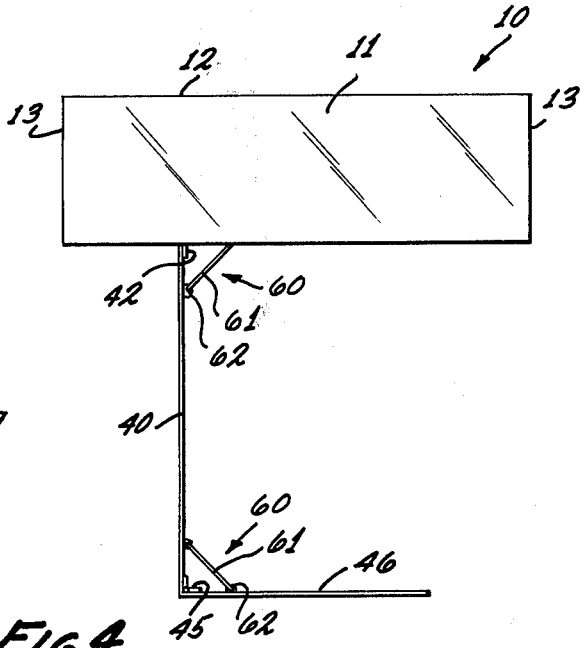
FIG. 4 is a plan view of FIG. 2.

To convert the unit 10 to a bar, the door 40 is opened as shown in FIGS. 1 and 2 and the extension member 46 is folded out. Bracing means 60, such as shown in FIG. 4, may then be used to lock the door 40 in a perpendicularly extending position from the front of the unit 10 and the extension member 46 in a position perpendicular to the door 40. The bracing means 60 shown are U-shaped rods 61 which extend downwardly into clamps 62 for receiving the downwardly extending rod ends.

With the lower door 40 and extension member 46 positioned as shown in FIGS. 2 and 4, the upper door 41 is pivoted downwardly to overlie and rest upon the door 40 and extension member 46. Thereby, the inside surface of the door 41 defines a bar top which is supported by the lower door 40 and extension member 46, the door 40 and extension member 46 being in turn supported by the rollers 48 on the floor surface 49.

It is noted that in the unit 10, the door 41 is preferably dimensioned to be longer than the door 40 so as to overlap from the bar side walls defined by the member 40 and 46 in a uniform manner.

Although the invention is herein shown in what is conceived to be the most practical and preferred embodiment, it is recognized that departures may be made therefrom.

What is claimed is:

1. A combination cabinet and fold-out bar comprising:

an upright cabinet having a generally rectangular front;

upper and lower doors hingedly mounted on said cabinet to lie flush with said front, when closed;

said upper door being of inverted L-shaped haviing a vertical leg, when closed extending upwardly along and closing one side of said cabinet and a horizontal leg, extending across and closing the upper part of said cabinet, the lower edge of said vertical leg being hinged to said cabinet on a first and horizontal axis spaced upwardly from the bottom of said cabinet;

said lower door being hinged to said cabinet on a second and vertical axis intermediate the ends of said first axis and having a horizontal upper edge at substantially the elevation of said first axis; and an extension panel hinged to an edge of said lower door on a third and vertical axis parallel to and spaced from said second axis by a distance less than the length of said vertical leg and having an upper horizontal edge at the same elevation as that of said lower door whereby said lower door may be opened to extend perpendicular to said cabinet front, said extension may be swung to extend parallel to and spaced from said cabinet front and said upper door may be swung downwardly to a position wherein its vertical and horizontal legs rest on the upper edges of said lower door and extension, respectively, to define an L-shaped bar providing standing room between said horizontal leg and cabinet and easy access to the interior of said cabinet.

2. A combination as defined in claim 1 including roller means at the lower edge of said lower door adjacent said third axis to contact a floor surface upon which said cabinet is positioned.

3. A combination as defined in claim 2 including further roller means at the lower edge of said extension panel adjacent the edge thereof remote from said third axis, to contact said floor surface.

4. A combination as defined in claim 1 including releasable means for holding said lower door fixed in position perpendicular to said cabinet front and for holding said extension panel fixed parallel to said cabinet front.

* * * * *